United States Patent [19]

Fujitani et al.

[11] Patent Number: 4,617,794

[45] Date of Patent: Oct. 21, 1986

[54] EXHAUST GAS PURIFYING METHOD AND APPARATUS FOR INTERNAL COMBUSTION ENGINES

[75] Inventors: Yoshiyasu Fujitani; Hideaki Muraki; Koji Yokota, all of Nagoya; Hideo Sobukawa; Shinichi Matsunaga, both of Aichi, all of Japan

[73] Assignee: Kabushiki Kaisha Toyota Chuo Kenkyusho, Japan

[21] Appl. No.: 740,427

[22] Filed: Jun. 3, 1985

[30] Foreign Application Priority Data

Jun. 6, 1984 [JP] Japan ..... 59-116102

[51] Int. Cl.[4] ..... F01N 3/20

[52] U.S. Cl. ..... 60/274; 60/276; 60/285

[58] Field of Search ..... 60/274, 276, 285, 286, 60/289

[56] References Cited

U.S. PATENT DOCUMENTS

| | | | |
|---|---|---|---|
| 4,024,706 | 5/1977 | Adawi | 60/274 |
| 4,148,188 | 4/1979 | Tokura | 60/285 |
| 4,199,938 | 4/1980 | Nakase | 60/289 |
| 4,376,369 | 3/1983 | Horikoshi | 60/285 |

*Primary Examiner*—William R. Cline

*Attorney, Agent, or Firm*—Parkhurst & Oliff

[57] ABSTRACT

Exhaust gas purifying method and apparatus for internal combustion engines in which the temperature of an exhaust gas purifying catalyst is detected and, as desired, oxygen content of exhaust gas is further detected, and in which the actual air-fuel ratio is varied toward the higher air-fuel ratio side and the lower air-fuel ratio side with respect to the theoretical air-fuel ratio, in accordance with the frequency and amplitude preset dependent on the kind of the catalyst and set based on these measured values.

14 Claims, 13 Drawing Figures

EXHAUST GAS PURIFYING METHOD AND APPARATUS FOR INTERNAL COMBUSTION ENGINES

BACKGROUND OF THE INVENTION

1. Field of the Invention

The present invention relates to a method and apparatus of purifying exhaust gas discharged from internal combustion engines, and more particularly to an exhaust gas purifying method and apparatus which is adapted to reduce detrimental components, i.e., nitrogen oxides, carbon monoxide and hydrocarbons, contained in exhaust gas with high efficiency.

2. Description of the Prior Art

Heretofore, there have been proposed various methods for reducing detrimental components, i.e., nitrogen oxides, carbon monoxide and hydrocarbons, contained in exhaust gas of internal combustion engines. Feedback control using an oxygen sensor can be cited as one of the methods practically employed in internal combustion engines for vehicles, etc. According to this method, the oxygen content of exhaust gas discharged from an internal combustion engine is detected by the oxygen sensor to judge whether an air-fuel ratio A/F is on the lean or rich side with respect to the theoretical A/F, and a signal is sent to a control unit such as a computer in accordance with the judgment to increase or reduce an amount of fuel, so that the actual A/F is controlled within a narrow range about the theoretical A/F.

But, an exhaust gas purifying catalyst has a purification characteristic variable dependent on the kinds of catalytic metals and reaction temperatures of catalytic metals. For example, therefore, in a catalytic system having such a characteristic that offers higher purification capability when variations in A/F are set larger with a catalytic layer ranging in lower temperatures and set smaller with the temperature rising up, it was impossible to achieve sufficient activity of an exhaust gas purifying catalyst from the range of lower temperatures by making use of the conventional systems.

SUMMARY OF THE INVENTION

It is an object of the present invention to provide an exhaust gas purifying method for internal combustion engines and an apparatus for implementing the method, which can achieve sufficient activity of an exhaust gas purifying catalyst disposed in an exhaust system of the internal combustion engine from he range of lower temperatures, and which will not deteriorate traveling efficiencies such as fuel consumption.

Namely, the exhaust gas purifying method for internal combustion engines according to the present invention comprises: detecting the temperature of an exhaust gas purifying catalyst disposed in an exhaust system of the internal combustion engine by a temperature sensor; converting a signal from the temperature sensor to an electric signal by a signal converter oscillating an electric signal having a frequency and amplitude present dependent on the kind of the catalyst and set in accordance with the electric signal from the signal converter by an oscillator; and varying an actual air-fuel ratio toward the higher air-fuel ratio side and the lower air-fuel ratio side with respect to the theoretical air-fuel ratio, based on the electric signal from the oscillator. Further, the air-fuel ratio may be further compensated in consideration of the oxygen concentration in the exhaust gas. The apparatus for implementing the above method according to the present invention comprises: an exhaust gas purifying catalyst disposed in an exhaust system; a temperature sensor attached to the catalyst; a signal converter for converting a signal from the temperature sensor to an electric signal; an oscillator for oscillating an electric signal having a frequency and amplitude preset dependent on the kind of the catalyst and set in accordance with the electric signal from the signal converter; and an air-fuel ratio compensator for issuing an electric signal adapted to change the weight ratio of air to fuel both supplied to the internal combustion engine, in accordance with the electric signal from the oscillator. The apparatus may further include a feedback device including an oxygen sensor, a lean counter, a rich counter and an arithmetic unit, for further compensating the air-fuel ratio.

DETAILED DESCRIPTION OF THE INVENTION

Figure 1:
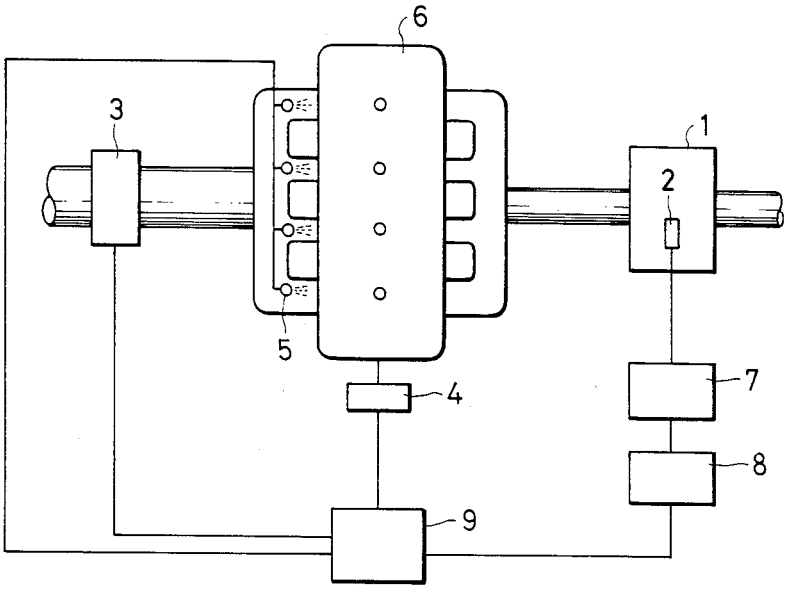
FIG. 1 is a diagrammatic view of an internal combustion engine and a controller showing one embodiment of an exhaust gas purifying method for internal combustion engines according to the present invention.

As catalysts available in the present invention, there are platinum, rhodium, palladium, etc., for example, which are usually employed as catalytic metals for purifying exhaust gas. Of course, the present invention is also applicable to those catalysts which are mixed with base metals such as cerium, lanthanum, iron, nickel, etc. for the purpose of enhancing activity of the above catalytic metals.

The exhaust gas purifying catalyst is formed, for example, such that alumina is coated on the surface of a carrier such as cordierite in the form of honeycomb, and the catalyst components are loaded on the alumina. To measure the temperature of the catalyst, a temperature sensor is attached in a location suitable for detecting the average temperature, e.g., within the catalyst carrier or near the outlet for exhaust gas having passed through the catalyst.

A temperature sensor can be made by use of a thermocouple, platinum resistor, etc. which are usually employed in the art. Then, by making use of a signal converter, the signal issued from the temperature sensor dependent on the temperature of catalyst is amplified and subjected to voltage/current conversion, as desired, when it is an electric signal, or converted to an electric signal if otherwise.

Upon receiving the electric signal, an oscillator transmits another electric signal having the frequency and amplitude preset dependent on the kind of the used catalyst and set in accordance with the electric signal from the signal converter, so that the optimum characteristic of exhaust gas purifying capability can be obtained. For exhaust gas purifying catalysts, the frequency is set in a range of 0.1–10 Hz, preferably 0.5–5 Hz. The signal waveform may be selected from a sine wave, a square wave, a sawtooth wave, and a combination thereof. It is preferable for usual exhaust gas purifying catalysts containing platinum, rhodium, palladium or the like as the catalytic components that, with the inverse in the temperature of catalytic layer, the amplitude of A/F becomes smaller but the frequency thereof becomes larger. Further, because the excessive amplitude of A/F tends to make unstable the operation of an internal combustion engine, its upper limit is set about 8%, preferably 1–6%, with respect to the theoretical air-fuel ratio.

An air-fuel ratio compensator varies A/F based on the electric signal from the oscillator. In case of an electronic fuel injection type, for example, an energizing time of an injector is varied. Also, in case of an carburetor type, A/F can be varied similarly.

By varying A/F in conformity with a characteristic of the exhaust gas purifying catalyst as mentioned above, it becomes possible to obtain sufficient activity of the catalyst from a range of lower temperatures. But, a more desirous purification characteristic can be attained by combining the aforesaid controller with a feedback device using an oxygen content sensor.

More specifically, the electric signal issued from the air-fuel ratio compensator according to the above-mentioned method and apparatus is preferably further corrected by a feedback device which comprises; an oxygen sensor attached to the outlet for exhaust gas of an internal combustion engine; a lean counter and a rich counter for measuring a period of time in which the actual air-fuel ratio is on the higher air-fuel ratio side and the lower air-fuel ratio side with respect to the theoretical air-fuel ratio, respectively, based on an electric signal from the oxygen sensor; and an arithmetic unit for calculating an air-fuel ratio correction factor based on electric signals from the lean counter and the rich counter.

As an oxygen sensor, there can be used an oxygen sensor which has an element consisted of an oxygen ion transmittable solid electrolyte such as zirconia, for example. By combining that feedback control using an oxygen sensor with the foregoing program control using a temperature sensor, it becomes possible to achieve sufficient activity of the exhaust gas purifying catalyst over a range from lower temperatures to higher temperatures in prompt response to fluctuations in driving conditions, etc. of a vehicle such as an automobile.

DESCRIPTION OF THE PREFERRED EMBODIMENTS

The present invention will be described hereinafter in more detail by referring to the following embodiments. It should be noted that the present invention will not be limited to the following embodiments.

Embodiment 1

Control by Temperature Sensor

FIG. 1 shows an example of control which is performed by a temperature sensor 2 attached to an exhaust gas purifying catalyst 1. An energyzing time ti (sec) of injectors 5 is determined based on both an intake air amount Q (g/min) measured by a flow meter 3 and the number of revolutions of engine N (rpm) detected by an ignition primary signal detector 4. More specifically, assuming now that an intake air amount q per revolution of an engine 6 is equal to Q/N (g) and the air-fuel ratio of a gas mixture is λ(A/F), a needed fuel injection amount f (g) is given as follows:

$$f=(q/\lambda)=(I/\lambda)\cdot(Q/N)(g) \quad (1)$$

On the other hand, because a fuel injection amount f per revolution of engine is proportional to the energyzing time ti (sec) of the injectors, the following equation is obtained from f=B·ti with the proportional constant assumed to be B (g/sec):

$$ti=(f/B)=[(I/B\cdot\lambda)]\cdot(Q/N) \quad (2)$$

Meanwhile, the temperature of the exhaust gas purifying catalyst 1 is measured by the temperature sensor 2 and then converted to a voltage signal T(v) by a signal converter (amplifier) 7. Next, an oscillator 8 is caused to transmit an electric signal having the frequency F′ (Hz) and amplitude A′ preset dependent on the kind of the catalyst and set with respect to the voltage signal T(v) (A′, F′ are functions of T). Subsequently, based on the electric signal from the oscillator, an air-fuel ratio compensator 9 modulates its output (air-fuel ratio) λ as represented by the equation (3) using a sine wave as a signal wave, for example, with reference output assumed to be λo:

$$\lambda=\lambda o+A'\sin 2\pi F't \quad (3)$$

By substituting the equation (3) into the equation (2), the energyzing time ti of the injectors is represented by the equation (4):

$$ti = \frac{1}{B(\lambda o + A'\sin 2\pi F't)} \cdot \frac{Q}{N} \quad (4)$$

The equation (3) means that the air-fuel ratio of exhaust gas varies about λo with the preset frequency F' and amplitude A' in response to the catalyst temperature. The product A'·F' of A' and F' means a disturbance in the air-fuel ratio, so there can be employed various methods in the equation (3) that, for example, A' is set constant and only F' is changed, or vice versa, or that the product A'·F' is set constant. From the viewpoint of catalytic activity, it is preferable to increase F' and reduce A' with the catalyst temperature rising up.

Embodiment 2

Control (1) by Temperature Sensor and Oxygen Sensor

Figure 2:
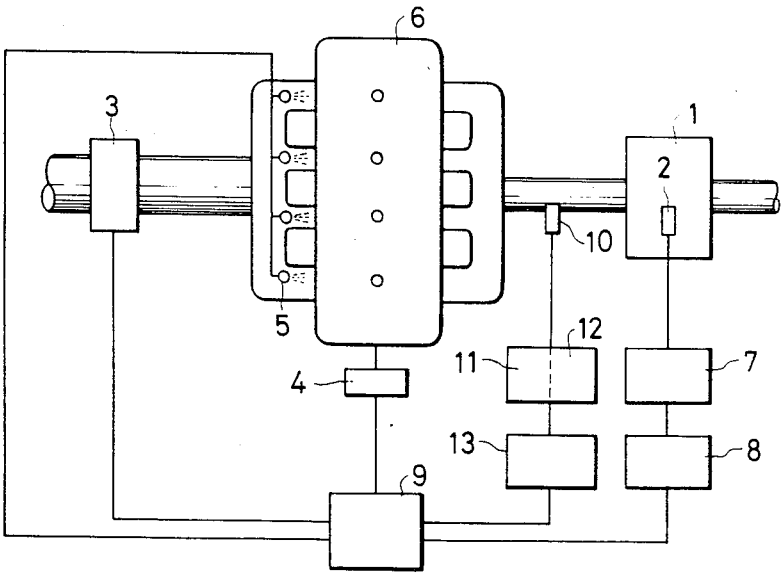
FIG. 2 is a diagrammatic view of an internal combustion engine and a controller showing another embodiment of the present invention.
Figure 3:
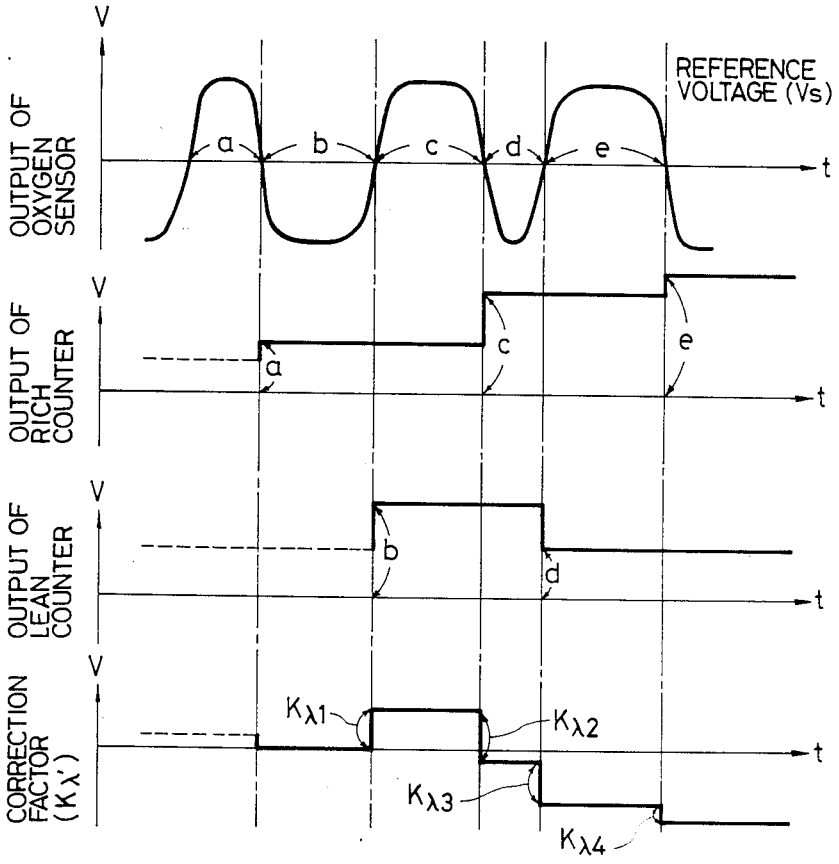
FIG. 3 is a set of graphs showing the process in which the air-fuel ratio correction factor employed for feedback control is calculated based on a signal from an oxygen sensor in the method of the present invention.

FIG. 2 shows an example of control which is performed by making use of a temperature sensor 2 attached to the catalyst and an oxygen sensor 10 attached in a passage of exhaust gas. An electric signal from the oxygen sensor 10 has such a characteristic that it rapidly varies on both sides of the theoretical air-fuel ratio. As shown in FIG. 3, reference voltage (slice level: Vs) is set near the middle point of such voltage variations to compare the current voltage V with Vs. The range of V>Vs represents the case where the actual air-fuel ratio is lower than the theoretical air-fuel ratio and, as shown in FIG. 3, a rich counter 11 in FIG. 2 issues the output corresponding to a period of time in which the state of V>Vs is being established. As will be seen from the figure, such the output continues until the next state of V>Vs has been completed. To the contrary, the range of V<Vs represents the case where the actual air-fuel ratio is higher than the theoretical air-fuel ratio, and a lean counter 12 in FIG. 2 issues the output corresponding to a period of time in which the state of V<Vs is being established. Next, the difference between a lean time and a rich time is determined and an arithmetic unit 13 in FIG. 2 then calculates an air-fuel ratio correction factor Kλ from the following equation (5):

$$K\lambda = \left(\frac{tL}{tL + tR} - 0.5\right) \cdot C \quad (5)$$

where tL; lean time, tR; rich time and C; constant

Thereafter, λo in the equation (4) obtained similarly to the Embodiment 1 is corrected by Kλ, thus resulting in the equation (6)

$$t'i = \frac{1}{B\{20 \cdot (1 - K'\lambda) + A'\sin 2\pi F't\}} \cdot \frac{Q}{N} \quad (6)$$

Herein, K'λ is a value integrated every time when the lean time or the rich time is newly measured, and has the relationship of the following equation (7):

$$K'\lambda = \Sigma K\lambda \quad (7)$$

By opening a valve of each injector 5 for a period of time ti given by the equation (6), the actual air-fuel ratio periodically varies about the theoretical air-fuel ratio with the frequency F' and amplitude A', while its deviation from the theoretical air-fuel ratio is automatically corrected. Accordingly, the composition of exhaust gas flowing into the catalyst also undergoes the optimum variations (higher activity) with respect to the catalyst temperature, so that nitrogen oxides (NOx), carbon monoxide (CO) and hydrocarbons (HC) in exhaust gas can be efficiently removed. In particular, this embodiment is superior to the Embodiment 1 in removal of NOx.

Embodiment 3

Control (2) by Temperature Sensor and Oxygen Sensor

Figure 4:
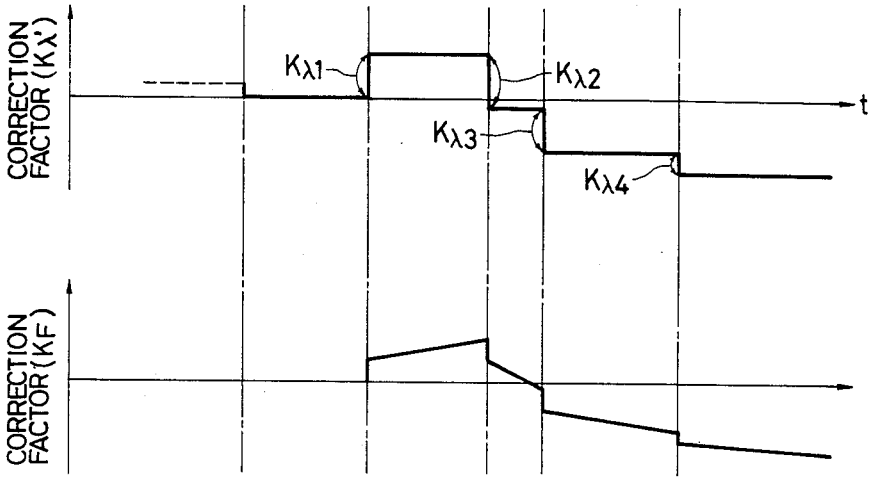
FIG. 4 is a set of graphs showing the process in which the air-fuel ratio correction factor of saw tooth waveform employed for PI control is calculated from the air-fuel ratio correction factor of square waveform, shown in FIG. 3, employed for on-off control.

Because the air-fuel ratio correction factor Kλ obtained by the equation (5) varies in the form of a square wave, the Embodiment 2 is subjected to on-off control. As a more stable control method, there is a PI (proportional integration) control, for example. In this control, for example, the air-fuel ratio correction factor $K_F$ is varied in the form of sawtooth wave as shown FIG. 4 in response to variations in Kλ of the Embodiment 2.

Embodiment 4

Figure 5:
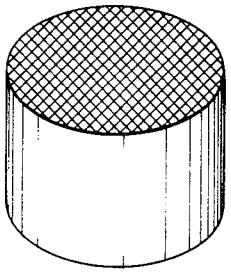
FIG. 5 is a perspective view showing one embodiment of an exhaust gas purifying catalyst.
Figure 6:
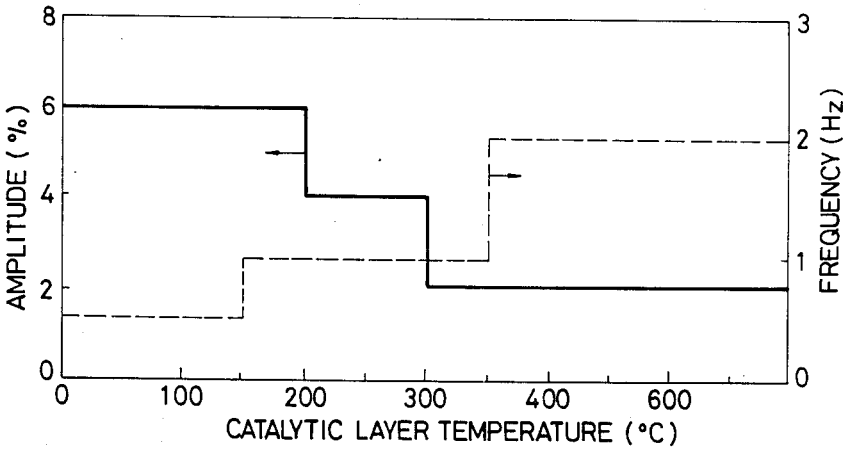
FIG. 6 is a graph showing a variation behaviour of the air-fuel ratio with respect to the preset catalytic layer temperatures for an exhaust gas purifying palladium catalyst.

Exhaust Gas Purification by Temperature Sensor Control Using Palladium (Pd) Catalyst δ-Alumina of specific surface area 50 $m^2/g$ was carried on a honeycomb-like carrier made of cordierite (volume 1.3 l) and palladium of 2.0 g/l was then carried thereon to prepare an exhaust gas purifying three-dimensional catalyst (shown in FIG. 5). This catalyst was cooled down to the room temperature and attached to a converter communicating with the exhaust system of a 6-cylindered gasoline engine of 2000 cc which had been sufficiently warmed up, thereafter the engine was restarted. With the engine set to operating conditions of 1600 rpm and boost pressure of −440 mmHg immediately after start-up, the temperature of catalytic layer was detected by the temperature sensor sensor and the air-fuel ratio was varied in accordance with the pattern as shown in FIG. 6. In this case, the center air-fuel ratio was controlled with the intake air amount only.

Comparison 1

Exhaust Gas Purification Using Pd Catalyst

Exhaust gas was purified in a similar manner to Embodiment 4, excluding variations in the air-fuel ratio as shown in FIG. 6.

Embodiment 5

Exhaust Gas Purification by Temperature Sensor and Oxygen Sensor Control Using Pd Catalyst With the same catalyst and engine operating conditions as those in the Embodiment 4, the air-fuel was varied except for that the center air-fuel ratio was controlled based on not only the intake air amount, but also the signal from the oxygen sensor, Control conditions was in conformity with the equations (5), (6) and (7) of the Embodiment 2. The contstant C was set to 0.3.

Comparison 2

Exhaust Gas Purification by Oxygen Sensor Control Using Pd Catalyst

The same catalyst and engine operating conditions as those in Comparison 1 were employed except for that the center air-fuel ratio was controlled by making use of the conventional practical control method.

Hereinafter, there will be described practical control methods.

Figure 7:
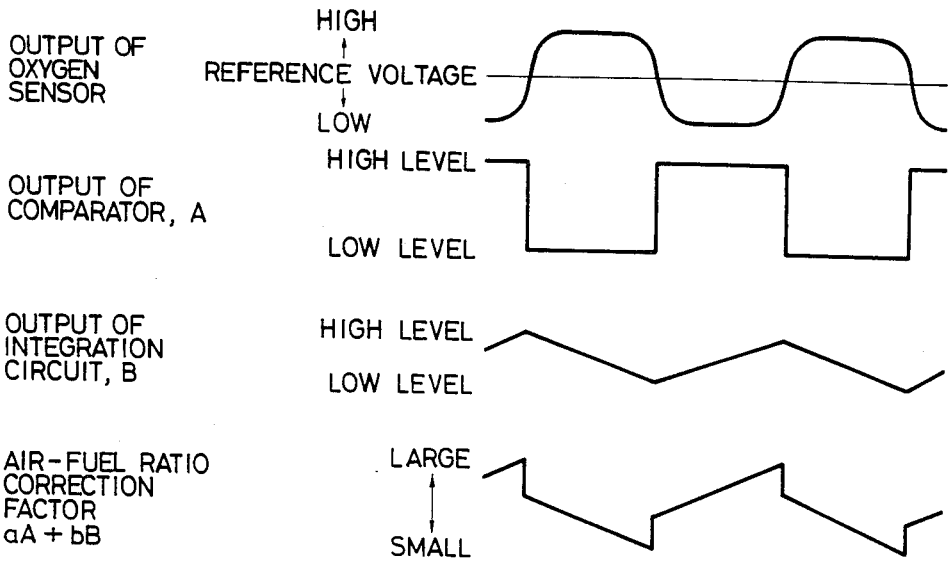
FIG. 7 is a set of graphs showing the process in which the air-fuel ratio correction factor employed for feedback control is calculated based on the signal from the oxygen sensor in the conventional control method.

Although various types of control methods have been practiced, the method which was adopted in Comparisons is to determine the reference fuel injection amount from the intake air amount and the number of revolutions using the folowing equation (8);

$$\text{Reference Fuel Injection Amount} = \frac{\text{Intake Air Amount}}{\text{Number of Revolutions}} \times (\text{Coefficient}) \quad (8)$$

and to correct the resulting reference fuel injection amount using a feedback signal from the oxygen sensor. FIG. 7 shows waveforms of output of the oxygen sensor, output of a comparator for comparing this output with the reference voltage to produce a lean signal and a rich signal, output of an integration circuit adapted for integration control, and output of the air-fuel ratio correction factor (PI control).

Figure 8:
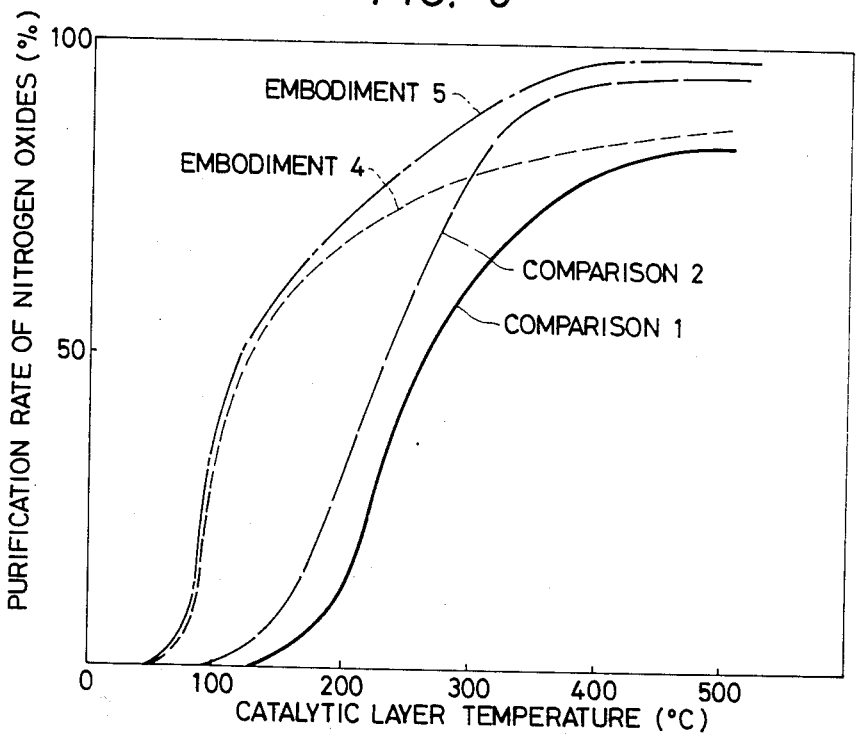
FIG. 8 is a graph showing the relationship between catalytic layer temperatures and purification rates of nitrogen oxides obtained by the present invention method and the conventional method, in case of using the exhaust gas purifying palladium catalyst.

FIG. 8 shows the relationship between catalytic layer temperatures and purification rates of nitrogen oxides for the Embodiments 4, 5 and Comparisons 1, 2. As can be seen by comparing the Embodiment 4 with the Comparison 1 and the Embodiment 5 with the Comparison 2, program control based on the electric signal from the temperature sensor attached to the catalytic layer permits the catalyst to exhibit the higher purificating capability from a range of lower temperatures (about 100° C.) than the conventional control. Further, by comparing the Embodiment 4 with the Embodiment 5, it will be found that a combination of program control based on the electric signal from the temperature sensor with feedback control based on the electric signal from the oxygen sensor provides the still higher purifying capability, particularly when the temperature of catalytic layer is high.

Tables 1 and 2 shows periods of time required to reach particular purification rates of nitrogen oxides (NOx) and carbon monoxide (CO) for the Embodiments 4, 5 and the Comparisons 1, 2.

TABLE 1

| Item | Comparison of Times Required to Reach Particular Purification Rates | | | |
|---|---|---|---|---|
| | Time Required to Reach Purification Rate of NOx (sec) | | Time Required to Reach Purification Rate of CO (sec) | |
| Purification Rates | Embodiment 4 | Comparison 1 | Embodiment 4 | Comparison 1 |
| 50% | 4.0 | 22.8 | 7.5 | 19.5 |
| 70% | 19.0 | 28.8 | 13.8 | 29.4 |
| 90% | — | — | 29.8 | 46.0 |

TABLE 2

| Item | Comparison of Times Required to Reach Particular Purification Rates | | | |
|---|---|---|---|---|
| | Time Required to Reach Purification Rate of NOx (sec) | | Time Required to Reach Purification Rate of CO (sec) | |
| Purification Rates | Embodiment 5 | Comparison 2 | Embodiment 5 | Comparison 2 |
| 50% | 4.0 | 18.8 | 7.5 | 16.4 |
| 70% | 18.0 | 27.6 | 14.2 | 22.4 |
| 90% | 35.5 | 45.6 | 29.8 | 36.0 |

As will be apparent from the Tables 1 and 2, the method of the present invention permits the catalyst to exhibit sufficient activity at the time earlier than the conventional method. This means that even when the temperature of catalytic layer is not so high, e.g., at the time of start-up of the vehicle, exhaust gas can be purified from the point of earlier time than the conventional method, and the present method is more preferable from the standpoint of preventing air pollution.

Figure 9:
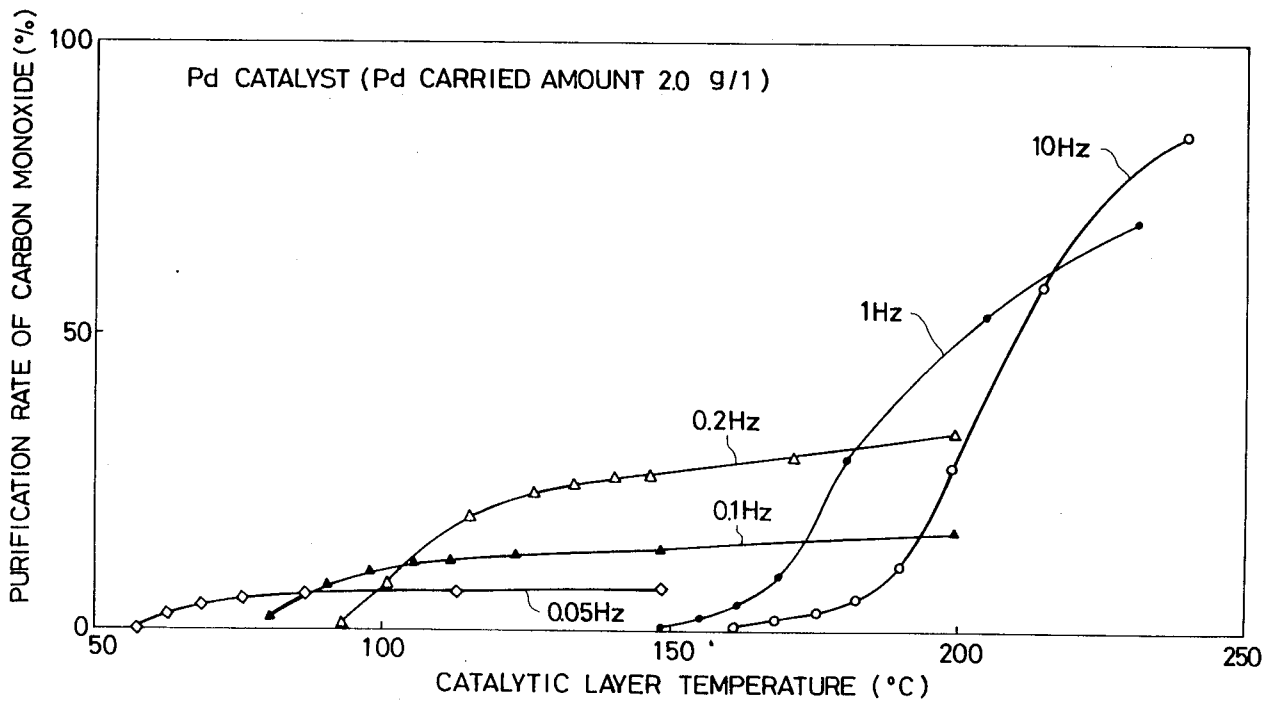
FIG. 9 is a graph showing the relationship between catalytic layer temperatures and purification rates of carbon monoxide obtained by changing variation frequencies of the air-fuel ratio in the method of the present invention, in case of using the palladium catalyst.

Further, FIG. 9 shows the relationship between catalytic layer temperatures and purification rates of carbon monoxide in case of using the same catalyst as the Embodiment 4 and changing the variational frequency of A/F. It will be found that the purification rate of carbon monoxide becomes higher by increasing the frequency with the temperature of catalytic layer rising up. Nitrogen oxides and hydrocarbons also have a similar tendency. It is, therefore, preferable to increase the variational frequency of A/F, as the temperature of catalytic layer is raised up. The increasing pattern of the frequency variations may have the stepwise form as shown in FIG. 6, the rectilinear form, or the curved form. Namely, it is selected at optimum in accordance with a characteristic of the catalyst. The pattern of changes in variation width is also selected at optimum in accordance with a characteristic of the catalyst likewise.

Embodiment 6

Running Test by Temperature Sensor and Oxygen Sensor Control Using Pd Catalyst An automobile loaded with the same catalyst and engine as those in Embodiment 4 was subjected to 10-mode running under the same control method as the Embodiment 5 to measure exhaust amounts of NOx, CO and HC as well as fuel consumption.

Comparison 3

Running Test by Conventional Practical Control Method Using Pd Catalyst

Similarly to the Embodiment 6, 10-mode running was conducted except for employing the practical control method described in the Comparison 2, to thereby measure exhaust amounts of NOx, CO and HC as well as fuel consumption.

The results of the Embodiment 6 and the Comparison 3 are summarized in the Table 3.

TABLE 3

| Item | Running Comparative Test | | |
|---|---|---|---|
| | Experiment | Embodiment 6 | Comparison 3 |
| 10-Mode Exhaust Amount (g/km) | NOx | 0.15 | 0.27 |
| | CO | 0.96 | 1.52 |
| | HC total | 0.10 | 0.15 |
| 10-Mode Fuel Consumption (km/l) | | 10.1 | 10.1 |

As will be apparent from this Table, the method of the present invention permits to reduce the exhaust amounts of respective detrimental components and will not deteriorate fuel consumption as compared with the conventional method.

Embodiment 7

Figure 10:
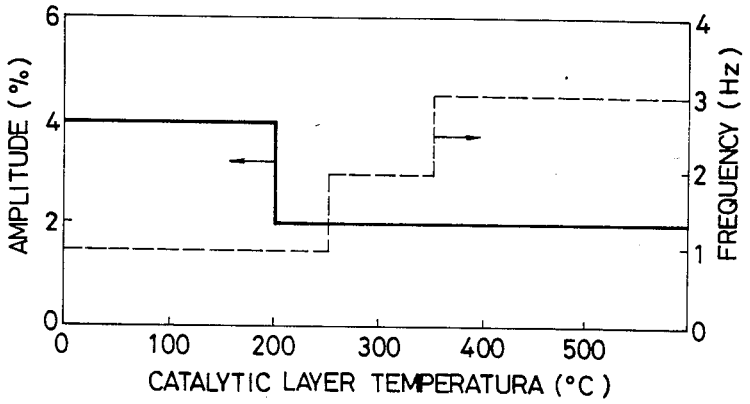
FIG. 10 is a graph showing a variation behaviour of the air-fuel ratio with respect to the preset catalytic layer temperatures for an exhaust gas purifying rhodium catalyst.

Exhaust Gas Purification by Temperature Sensor and Oxygen Sensor Control Using Rhodium (Rh) Catalyst An exhaust gas purifying catalyst was prepared using the same carrier and method as those in the Embodiment 4 except for that rhodium of 0.2 g/l was carried on the carrier in place of palladium. The experiment was conducted under control by the oxygen content sensor in the same manner as the Embodiment 5 following the equation (6) described in the Embodiment 5 except for that the variation pattern of the air-fuel ratio was in conformity with FIG. 10.

Comparison 4

Exhaust Gas Purification by Oxygen Sensor Control Using Rh Catalyst

The experiment was conducted using the same catalyst and method as those in the Embodiment 7 except for that the practical control method described in the Comparison 2 was employed as a control method.

Figure 11:
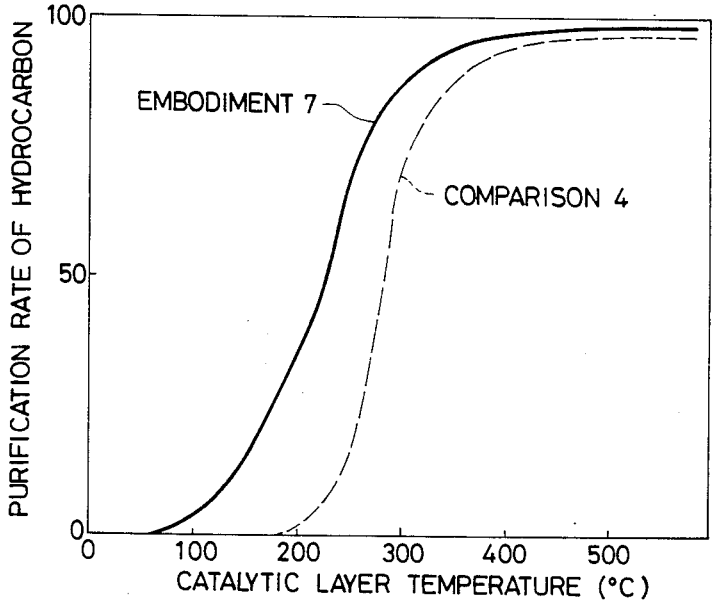
FIG. 11 is a graph showing the relationship between catalytic layer temperatures and purification rates of hydrocarbons obtained by the present invention method and the conventional method, in case of using the exhaust gas purifying rhodium catalyst.

FIG. 11 shows the relationship between catalytic layer temperatures and purification rates of hydrocarbons for the Embodiment 7 and the Comparison 4. It will be found from the figure that the method of the present invention permits the catalyst to exhibit its purifying capability from a range of lower temperatures than the conventional method.

Embodiment 8

Figure 12:
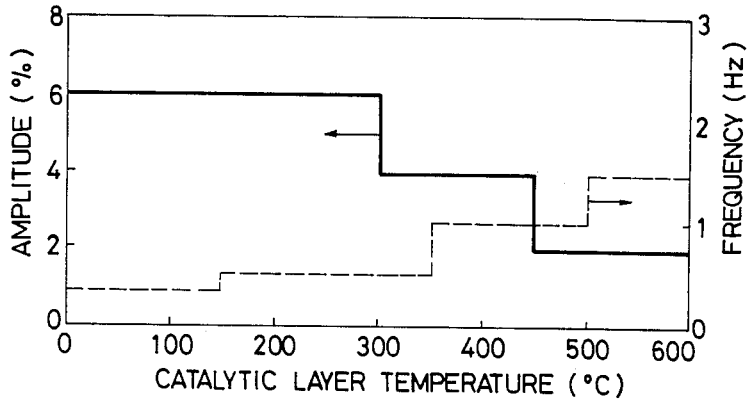
FIG. 12 is a graph showing a variation behavior of the air-fuel ratio with respect to the preset catalytic layer temperatures for an exhaust gas purifying platinum catalyst.

Exhaust Gas Purification by Temperature Sensor and Oxygen Sensor Control Using Platinum (Pt) Catalyst An exhaust gas purifying catalyst was prepared using the same carrier and method as those in the Embodiment 4 except for that platinum of 2.0 g/l was carried on the carrier in place of palladium. The experiment was then conducted in conformity with the variation pattern of the air-fuel ratio of FIG. 12.

Comparison 5

Exhaust Gas Purification by Oxygen Sensor Control Using Pt Catalyst

The experiment was conducted using the same catalyst and method as those in the Embodiment 8 except for that the practical control method described in the Comparison 2 was employed as a control method.

Figure 13:
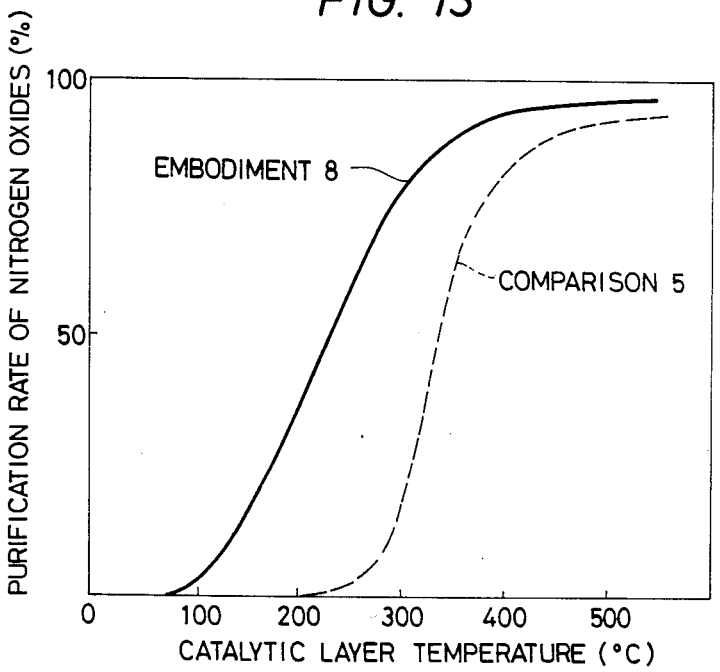
FIG. 13 is a graph showing the relationship between catalytic layer temperatures and purification rates of nitrogen oxides obtained by the present invention method and the conventional method, in case of using the platinum catalyst.

FIG. 13 shows the relationship between catalytic layer temperatures and purification rates of nitrogen oxides for the Embodiment 8 and the Comparison 5. It will be apparent from the figure that the method of the present invention permits the catalyst to exhibit its purifying capability from a temperature range lower about 100° C. than the conventional method.

As described hereinabove, according to the exhaust gas purifying method and apparatus of the present invention, the actual air-fuel ratio is subjected to program control to be varied toward the higher air-fuel ratio side and the lower air-fuel ratio side with respect to the theoretical air-fuel ratio, based on a signal from the temperature sensor for detecting the temperature of the exhaust gas purifying catalyst, in accordance with the pattern preset dependent on the kind of the catalyst so that the catalyst exhibits the optimum activity at respective different temperatures, and as desired, the actual air-fuel ratio is further corrected by feedback control based on a signal from the oxygen sensor attached to the outlet for exhaust gas of an internal combustion engine, whereby various types of catalysts can be caused to enhance its purifying capability as compared with the conventional method, and particularly to exhibit the sufficient activity from a range of lower temperatures. Further, particularly in case of using a palladium catalyst, there can be attained more valuable effect. That is, since the sufficient purification characteristic is provided in a range of lower temperature than the prior art, it becomes possible to employ palladium in place of rhodium or platinum which is more expensive and rarer resources, thereby offering benefits also in points of economy and resources.

Moreover, since application of the method and apparatus of the present invention will not deteriorate fuel consumption of automobiles, excellent exhaust gas purifying capability can be attained over all the stages from start-up of an engine to normal crusing of automobiles without causing economical disadvantage, thus resulting in another valuable effect of preventing air pollution.

What is claimed is:

1. An exhaust gas purifying method for an internal combustion engine comprising:

detecting the temperature of an exhaust gas purifying catalyst disposed in an exhaust system of said internal combustion engine by a temperature sensor;

converting a signal from said temperature sensor to a first electric signal by a signal converter;

oscillating a second electric signal having a frequency and an amplitude and a predetermined frequency and amplitude range, said predetermined frequency and amplitude range being predetermined based upon the kind of said catalyst used, the frequency and amplitude of said second signal being adjusted within said predetermined range by an oscillator in accordance with said first electric signal from said signal converter; and varying an actual air-fuel ratio toward the higher air-fuel ratio side and the lower air-fuel ratio side with respect to the theoretical air-fuel ratio, based on said second electric signal from said oscillator.

2. The method according to claim 1, further comprising;

detecting an oxygen concentration in exhaust gas by an oxygen sensor;

measuring a period of time in which the actual air-fuel ratio is on the higher air-fuel ratio side and the lower air-fuel ratio side with respect to the theoretical air-fuel ratio by a lean counter and a rich counter, respectively, based on the detected oxygen concentration; and compensating the air-fuel ratio in accordance with a third electric signal from said lean counter and a fourth electric signal from said rich counter.

3. The method according to claim 1 or 2, wherein the catalyst comprises at least one of the group consisting of platinum, rhodium and palladium.

4. The method according to claim 1 or 2, wherein the carrier used for the catalyst is of a honeycomb-like structure.

5. The method according to claim 1 or 2, wherein the second electric signal having said frequency and amplitude has the waveform selected from the group consisting of a sine wave, a square wave, a sawtooth wave and a combination thereof.

6. The method according to claim 1 or 2, wherein said air-fuel ratio has an amplitude and a frequency and wherein said amplitude and frequency of said second electrical signal are adjusted within said predetermined range so that at least one of said amplitude of the air-fuel ratio becomes smaller and said frequency becomes larger, in response to the increase of temperature of said catalyst.

7. The method according to claim 1 or 2, wherein said amplitude and frequency are adjusted within said predetermined range so that an amplitude of the air-fuel ratio is in the range of 1 to 8% with respect to the theoretical air-fuel ratio, and a frequency thereof is in the range of 0.1 to 10 Hz.

8. An exhaust gas purifying apparatus for an internal combustion engine comprising: an exhaust gas purifying catalyst disposed in an exhaust system; a temperature sensor attached to said catalyst; a signal converter for converting a signal from said temperature sensor to a first electric signal; an oscillator for oscillating a second electric signal having a predetermined frequency and amplitude said predetermined frequency and amplitude being predetermined base upon the kind of said catalyst used, the frequency and amplitude of said second signal being adjusted within said predetermined range in accordance with the first electric signal from said signal converter; and an air-fuel ratio compensator for issuing a third electric signal adapted to change the weight ratio of air to fuel both supplied to said internal combustion engine, in accordance with the second electric signal from said oscillator.

9. The apparatus according to claim 8, further comprising a feedback device for compensating said third electric signal issued from said air-fuel ratio compensator, said feedback device including: an oxygen sensor for detecting an oxygen concentration in exhaust gas of said internal combustion engine; a lean counter and a rich counter for measuring a period of time in which the actual air-fuel ratio is on the higher air-fuel side and the lower air-fuel ratio side with respect to the theoretical air-fuel ratio, respectively, based on a fourth electric signal from said oxygen sensor; and an arithmetic unit for calculating an air-fuel ratio correction factor based on a fifth electric signal from said lean counter and a sixth electric signal from said rich counter.

10. The apparatus according to claim 8 or 9, wherein the catalyst comprises at least one of the group consisting of platinum, rhodium and palladium.

11. The apparatus according to claim 8 or 9, wherein a carrier used for the catalyst is of a honeycomb-like structure.

12. The apparatus according to claim 8 or 9, wherein said second electric signal having said frequency and amplitude has a waveform selected from the group consisting of a sine wave, a square wave, a sawtooth wave and a combination thereof.

13. The apparatus according to claim 8 or 9 wherein said amplitude and frequency are adjusted so that an amplitude of the air-fuel ratio becomes smaller and a frequency thereof becomes larger with the increase of temperature of said catalyst.

14. The apparatus according to claim 8 or 9, wherein said amplitude and frequency are adjusted so that an amplitude of the air-fuel ratio is in the range of 1 to 8% with respect to the theoretical air-fuel ratio, and a frequency thereof is in the range of 0.1 to 10 Hz.

* * * * *